US005303454A

United States Patent [19]

Stahlecker et al.

[11] Patent Number: 5,303,454

[45] Date of Patent: Apr. 19, 1994

[54] TEXTILE MACHINE COMPRISING A PLURALITY OF DRAFTING UNITS ARRANGED NEXT TO ONE ANOTHER IN A ROW

[75] Inventors: Hans Stahlecker, Haldenstrasse 20, 7334 Süssen; Norbert Barauke, Donzdorf, both of Fed. Rep. of Germany

[73] Assignees: Fritz Stahlecker, Bad Ueberkingen; Hans Stahlecker, Suessen, both of Fed. Rep. of Germany

[21] Appl. No.: 4,240

[22] Filed: Jan. 14, 1993

[30] Foreign Application Priority Data

Feb. 26, 1992 [DE] Fed. Rep. of Germany ..... 4205854

[51] Int. Cl.[5] ..... D01H 5/56

[52] U.S. Cl. ..... 19/236; 19/294; 19/261; 384/258

[58] Field of Search ..... 19/236, 258, 259, 260, 19/261, 293, 294; 57/315, 328; 384/257, 258, 252

[56] References Cited

U.S. PATENT DOCUMENTS

| | | | |
|---|---|---|---|
| 439,339 | 10/1890 | Bailey | 19/261 |
| 1,167,375 | 1/1916 | Brock | 384/258 |
| 1,237,229 | 8/1917 | White | 384/257 |
| 1,278,500 | 9/1918 | Pereira et al. | 384/258 |
| 1,395,284 | 11/1921 | Leonard et al. | 19/260 |
| 2,446,021 | 7/1948 | Noguera | 19/294 |
| 2,922,198 | 1/1960 | Barrett | 19/261 |
| 2,958,103 | 11/1960 | Schrotz | 19/266 |
| 3,216,065 | 11/1965 | Grieb | 19/294 |
| 3,504,954 | 4/1970 | Robson | 384/252 |

FOREIGN PATENT DOCUMENTS

| | | | |
|---|---|---|---|
| 1292557 | 12/1969 | Fed. Rep. of Germany . | |
| 3532555 | 3/1987 | Fed. Rep. of Germany . | |
| 250725A | 10/1987 | Fed. Rep. of Germany . | |
| 510673 | 12/1920 | France | 384/258 |
| 982878 | 2/1965 | United Kingdom . | |

*Primary Examiner*—Clifford D. Crowder
*Assistant Examiner*—John J. Calvert
*Attorney, Agent, or Firm*—Evenson, McKeown, Edwards & Lenahan

[57] ABSTRACT

In the case of a textile machine comprising drafting units that are disposed next to one another, the bottom cylinders are arranged in the longitudinal direction of the machine so that they continue along several or all drafting units. The continuous bottom cylinders are disposed at several bearing points which are arranged at a spacing from one another in the longitudinal direction of the machine. It is provided, in the case of the delivery bottom cylinder, to design at least some of the bearing points such that they can be radially adjusted. As a result, radial directional deviations of the delivery bottom cylinder can be compensated which occur along its longitudinal dimension.

22 Claims, 5 Drawing Sheets

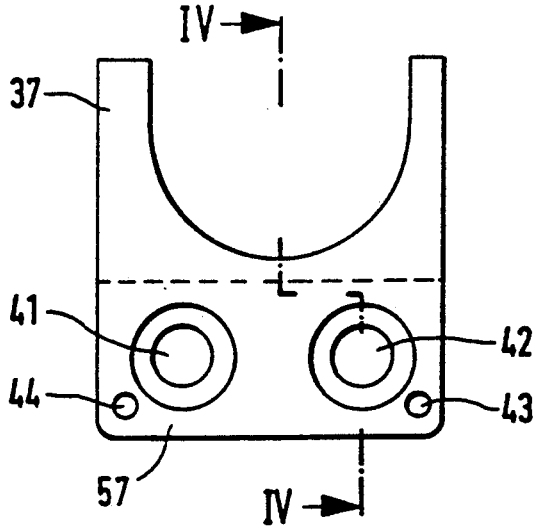
Fig.3
Fig.4
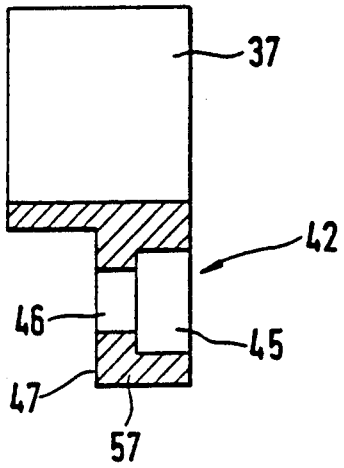
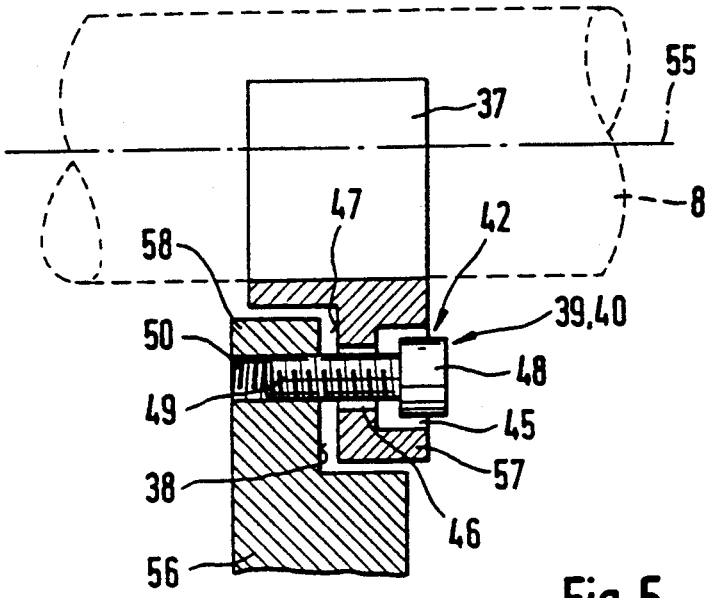
Fig.5

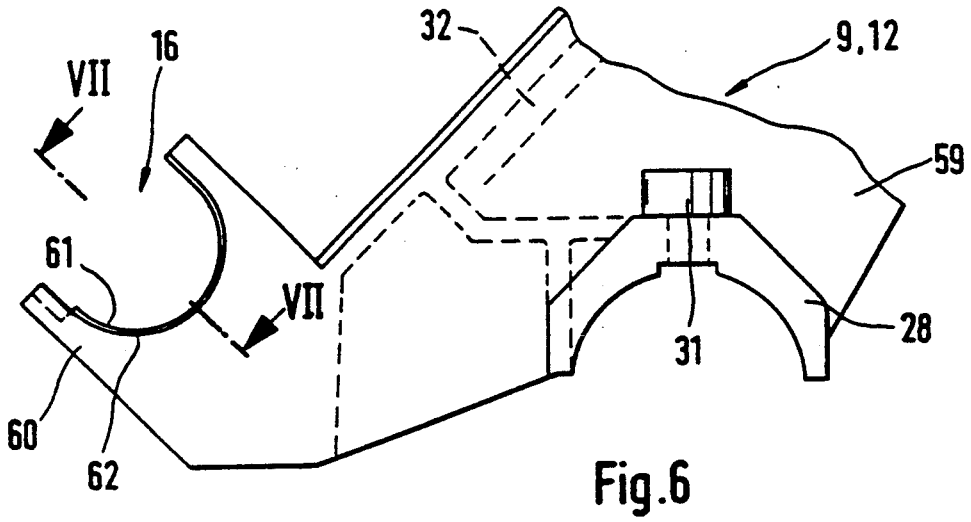
Fig.6
Fig.7
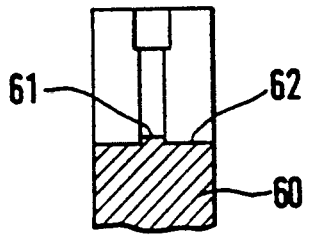
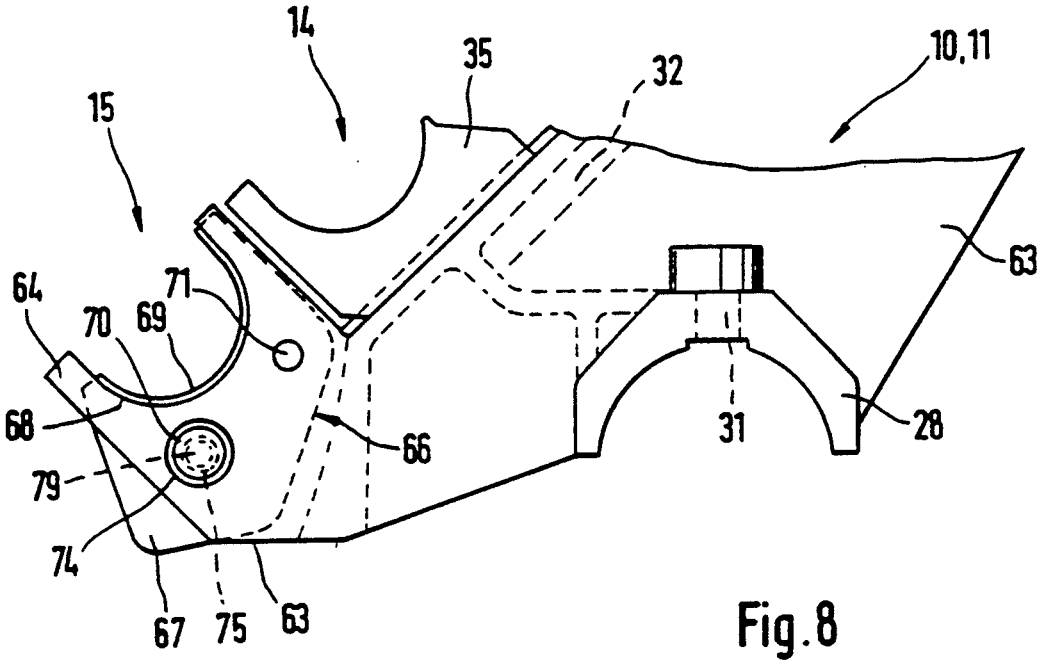
Fig.8

TEXTILE MACHINE COMPRISING A PLURALITY OF DRAFTING UNITS ARRANGED NEXT TO ONE ANOTHER IN A ROW

BACKGROUND AND SUMMARY OF THE INVENTION

This invention relates to a textile machine comprising a plurality of drafting units arranged next to one another in a row. Bottom cylinders of the drafting units, which extend through in the longitudinal direction of the machine along several or all drafting units, are disposed at bearing points which are arranged at a distance from one another.

In the case of textile machines comprising drafting units which are disposed next to one another, the bottom cylinders are normally designed in such a manner that they continue in the longitudinal direction of the machine along several or all drafting units. The continuous bottom cylinders are disposed at several bearing points which are arranged in the longitudinal direction of the bottom cylinder at a distance from one another. As a rule, the bottom cylinders are composed of several segments which are connected with one another at the bearing points by means of bottom cylinder couplings. For the bearing of the bottom cylinders, roller bearings are used which are accommodated at the bearing points in roller stands which are connected with the machine frame and are in each case provided at the distance of several drafting units. The delivery bottom rollers are rigidly, that is, radially unslidably, disposed at the roller stands, while the bearings or bearing receiving devices for the bottom cylinders disposed in front of the delivery bottom cylinder are guided at the roller stands in one rail respectively which extend transversely to the longitudinal direction of the machine and permit an adjusting of the distance to the respective adjacent bottom roller. An arrangement of this type is illustrated and described, for example, in the German Patent Document DE-OS 35 32 555.

It was found that the continuous bottom cylinders do not have a straight course along their whole length. These deviations in the radial direction may result in tensions mainly in the area of the bearing points and of the connecting points of the segments of the delivery bottom cylinder. Although it would be possible for the elimination of these radial deviations to adjust the height of the machine frame at different points of its longitudinal dimension, such an adjustment of the machine frame would also affect the position of other machine parts. Such an adjustment will also not be useful if the radial deviations in the case of the delivery bottom cylinder are based on variations in dimensions in the case of the roller stands themselves or in the case of the machine parts supporting them. In this case, deviations may, for example, be the result of nonlinear longitudinal supports on which the roller stands are held, or of manufacturing inaccuracies in the case of the roller stands. If the roller stands are each held by several longitudinal supports, slight deviations in the case of each longitudinal support may add up to a considerable deviation of the bearing positions for the delivery bottom cylinders in the case of the roller stand. This may then have the result that the bearings for the delivery bottom cylinders may no longer rest with a close fit in the bearing receiving devices of the roller stands.

For solving the above-described problems, it has been suggested to arrange the segments of the bottom cylinders cardanically movably at the connecting and bearing points (German Patent Document DE-PS 12 92 557 and British Patent Document GB-PS 982 878). However, in the case of this arrangement, the radial deviations themselves cannot be compensated; on the contrary, the problems are only to be reduced which occur as a result of the radial deviation. In addition, the suggested construction has the disadvantage that considerable constructional expenditures are required with respect to the design of the bearings and of the couplings.

It is an object of the invention to provide a method of construction in which radial deviations are compensated at the bearing points of the continuous delivery bottom cylinder.

This object is achieved in that, in the case of the delivery bottom cylinder, at least some of the bearing points are radially adjustable.

By means of the construction according to the invention, the advantage is achieved that, when the roller stands and the supporting elements accommodating these roller stands are manufactured and arranged, no narrow tolerances must be maintained. Even when the position of the bearing points for the delivery bottom cylinder depends on several inaccurately manufactured and inaccurately arranged structural elements of the machine frame, this inaccuracy can easily be compensated by the adjusting of the bearing point in the radial direction according to the invention. The delivery bottom cylinders may be precisely aligned in the longitudinal direction of the machine so that the segments are in alignment with one another along the whole dimension of the delivery bottom roller. However, it may also be sufficient to only roughly align the bearing points and to accept slight radial deviations. In any case, by means of the radial adjustability in the case of the bearing points, it may be achieved that the bearings rest in the bearing receiving devices with a close fit and that tensions are avoided.

In an advantageous development of the invention, not all bearing points in the case of a delivery bottom cylinder are designed to be radially adjustable. At a distance of at least one radially adjustable bearing point, one bearing point respectively which is not radially adjustable may be arranged in the case of the delivery bottom cylinder. The non-adjustable bearing points may preferably be provided at such points in the case of the machine frame which are determined with a relatively high precision with respect to their position in the case of the machine frame, such as at positions with a perpendicular connection of the machine frame with the floor of the spinning room. The adjustable bearing points may also be aligned according to the position of the non-adjustable bearing points, in which case an adjustment with slight radial deviations is easily possible.

The adjustable bearing points may be designed in such a manner that the bearings proper may be displaced and adjusted inside bearing receiving devices. Instead, it may be provided in an advantageous further development of the invention that the bearings are rigidly fastened in bearing receiving devices and the bearing receiving devices are arranged in a radially slidable manner.

In an advantageous development, the bearings or the bearing receiving devices are fastened at the bearing points on holding devices which are connected with the machine frame at a distance of several drafting units. As a rule, it is not required to dispose the continuous delivery bottom cylinder behind one drafting unit respectively. Roller stands are expediently used as holding devices which receive the bearings for all bottom rollers of the drafting units, thus for the delivery bottom roller and the slidable bottom rollers which are disposed in front of this delivery bottom roller.

In an advantageous further development of the invention, the holding devices are fastened to at least one longitudinal support of the machine frame. As a result, a constructionally simple connection is obtained between the holding devices and the machine frame. In this case, the longitudinal support or supports rest on perpendicular supports of the machine frame at a distance of at least one holding device. Variations in the dimensions of the longitudinal supports, particularly deflections, may have the result that the bearing receiving device for the delivery bottom cylinder in the case of one holding device is in a different position than in the case of the adjacent holding device. The holding devices which are arranged in the proximity of the perpendicular supports of the machine on the longitudinal support or supports are relatively exact in their position. If several longitudinal supports are used for the fastening of the holding devices, the deviations in the case of the holding devices may add up under certain circumstances. Particularly in this case, the radial adjustability of the bearing points at the delivery bottom rollers is very suitable for the compensation of the relatively large deviation.

In an advantageous development, the hinges for the loading arms of the drafting units are arranged on one of several longitudinal supports so that this longitudinal support has a double function.

It is advantageous to provide the longitudinal support or the longitudinal supports with the shape of a cylinder or a hollow cylinder.

In an advantageous development, the slidable bearing receiving devices are provided with contact surfaces by means of which they rest against mating surfaces, which are connected with the machine frame, and can be fixed in an adjusted position by means of fastening devices. In this case, the mating surfaces are advantageously arranged on holding devices which, in turn, are connected with the machine frame. The slidability of the bearing receiving device along a mating surface permits a simple and reliable adjusting of the bearing receiving device.

It is advantageous to provide screws as fastening devices which are arranged perpendicularly with respect to the contact surfaces and the mating surfaces. In this case, the screws and/or the contact surfaces can be moved in the radial direction of the delivery bottom cylinder relative to the mating surfaces. As a result of the relative mobility, the bearing receiving devices may be displaced in the radial direction of the delivery bottom cylinder and may be fixed in the displaced position in that the contact surface is screwed to the mating surface.

It is advantageous to arrange the contact surfaces and the mating surfaces at least approximately perpendicularly with respect to the axis of the delivery bottom cylinder. The contact surfaces and the mating surfaces will then extend essentially in the same direction as the radial planes of the delivery bottom cylinder, whereby a good slidability and adjustability becomes possible.

Other objects, advantages and novel features of the present invention will become apparent from the following detailed description of the invention when considered in conjunction with the accompanying drawings.

BRIEF DESCRIPTION OF THE DRAWINGS

FIG. 3 is a lateral view, which is enlarged with respect to FIG. 2, of a bearing receiving device of the roller stand of FIG. 2;

FIG. 4 is a sectional view along Line IV—IV of the bearing receiving device of FIG. 3;

FIG. 5 is a view of the bearing receiving device of FIG. 4 with a partial sectional view of the roller stand and of the delivery bottom roller;

FIG. 6 is a partial view, which is enlarged with respect to FIG. 1, of a roller stand of the ring spinning machine of FIG. 1, with a bearing point for the delivery bottom cylinder which cannot be radially adjusted;

FIG. 7 is a sectional view of the bearing receiving device of the roller stand of FIG. 6 along Line VII—VII of FIG. 6;

FIG. 8 is a partial view of another embodiment of a roller stand with a radially adjustable bearing for the delivery bottom cylinder;

DETAILED DESCRIPTION OF THE DRAWINGS

Figure 1:
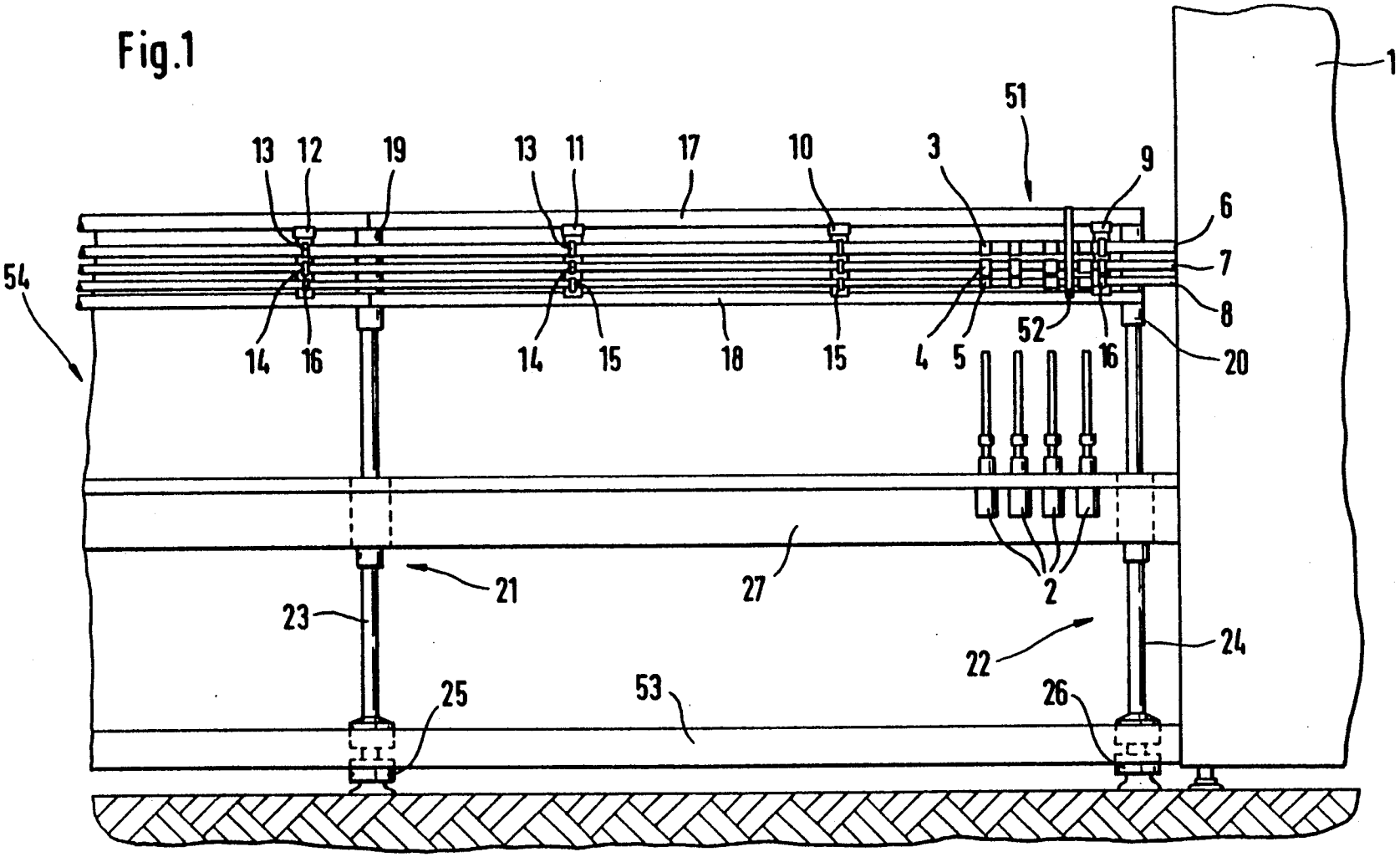
FIG. 1 is a partial longitudinal view of a ring spinning machine.

The ring spinning machine illustrated in FIG. 1 essentially comprises the machine frame 54, which extends in the longitudinal direction of the machine and carries the spinning elements, and the supply block 1 which is arranged at the head of the ring spinning machine and comprises, among other parts, the drive assemblies and the machine control system. The spinning machine comprises a plurality of spinning stations which are arranged next to one another in the longitudinal direction of the machine. A drafting unit 51 and a spindle 2 as well as additional spinning elements not illustrated in FIG. 1 are assigned to each spinning station. FIG. 1 shows only a few of the drafting units 51 and spindles 2. In reality, a ring spinning machine comprises several hundreds of such drafting units 51 and spindles 2.

The machine frame 54 is composed of longitudinal supports 17, 18, 27, 53 and transverse stands 21, 22 which are connected at a distance from one another with the longitudinal supports 17, 18, 27, 53. The transverse stands 21, 22 have perpendicularly extending pillars 23, 24 which extend to the floor of the spinning room and are supported there by means of vertically adjustable bases 25, 26. The longitudinal supports 17, 18, 27, 53 and the spinning elements supported by them are therefore perpendicularly supported by the transverse stands 21, 22. The longitudinal supports 17, 18 of the upper machine area are screwed to traverses 19, 20 of the transverse stands 21, 22 which extend transversely with respect to the longitudinal direction of the machine. The machine area between two adjacent transverse stands 21, 22 forms one section respectively. The longitudinal supports 17, 18 are composed of segments which each have the length of one section and therefore extend in each case from traverse to traverse.

The spindles 2 are fastened next to one another to the longitudinal support 27. They are driven by a tangential belt which is not shown in detail, preferably one tangential belt being provided for each section.

The drafting units 51 are designed as so-called twin drafting units; therefore the top rollers of two adjacent drafting units respectively are assigned to a common loading arm 52. Each loading arm 52 is provided with a hinge which is fastened to the longitudinal support 17 and permits a swivelling about the longitudinal support 17 as the swivelling axis.

The bottom rollers 3, 4, 5 assigned to each drafting unit 51 are non-rotatably arranged on bottom cylinders 6, 7, 8 which extend through in the longitudinal direction of the machine along several drafting units 51. As customary, in the case of the continuous bottom cylinders 6, 7, 8, the bottom rollers 3, 4, 5 are not designed as separate components, but the continuous bottom cylinders 6, 7, 8 have a special surface structure in the area of the drafting units 51, such as a diagonal knurling. The bottom rollers 3, 4, 5 are therefore formed by the special surface structure in the case of the bottom cylinders 6, 7, 8.

Starting from the supply block 1, the bottom cylinders 6, 7, 8 extend in the longitudinal direction of the ring spinning machine along a fairly large number of drafting units 51. The bottom cylinders 6, 7, 8 are disposed in roller stands 9, 10, 11, 12 which are arranged at a distance of several drafting units 51. The bottom cylinders 6, 7, 8 are composed of segments which in each case extend from one roller stand to the adjacent roller stand and are connected there with one another at bearing points 13, 14, 15, 16 by couplings which are not shown. The bottom cylinders 6, 7, which are disposed in front of the delivery bottom cylinder 8, are transversely slidably disposed at roller stands 9, 10, 11, 12; the distance of the bottom rollers 6, 7 with respect to one another and with respect to the delivery bottom roller 8 can therefore be adjusted in an adaptation to the respective spinning conditions. This adjustability of the bottom rollers 6, 7 takes place by a slidable arrangement of the bearing points 13, 14 which will be described in the following.

The delivery bottom roller 8 cannot be adjusted with respect to its distance to the other bottom rollers 6, 7. However, the bearing points 15 are arranged to be movable relative to the roller stands 10, 11 so that a sliding in the radial direction of the delivery bottom roller 8 is possible. This sliding possibility exists only within certain limits and has the purpose of aligning the delivery bottom roller 8 or its segments. In the case of the spinning machine illustrated in FIG. 1, only the bearing points 15 of the roller stands 10, 11 can be adjusted, while the bearing points 16 of the roller stands 9, 12 are arranged rigidly and cannot be adjusted. The roller stands 9, 12 with the rigidly arranged bearing points 16 are in each case arranged in the proximity of the intermediate frames 21, and 22 and are therefore not subjected to the risk of deflection as much as the roller stands 10, 11.

The roller stands 9, 10, 11, 12 are supported by the longitudinal supports 17, 18 and are screwed to them. The longitudinal supports 17, 18 supporting the roller stands 9, 10, 11, 12 have a cylindrical cross-section.

Figure 2:
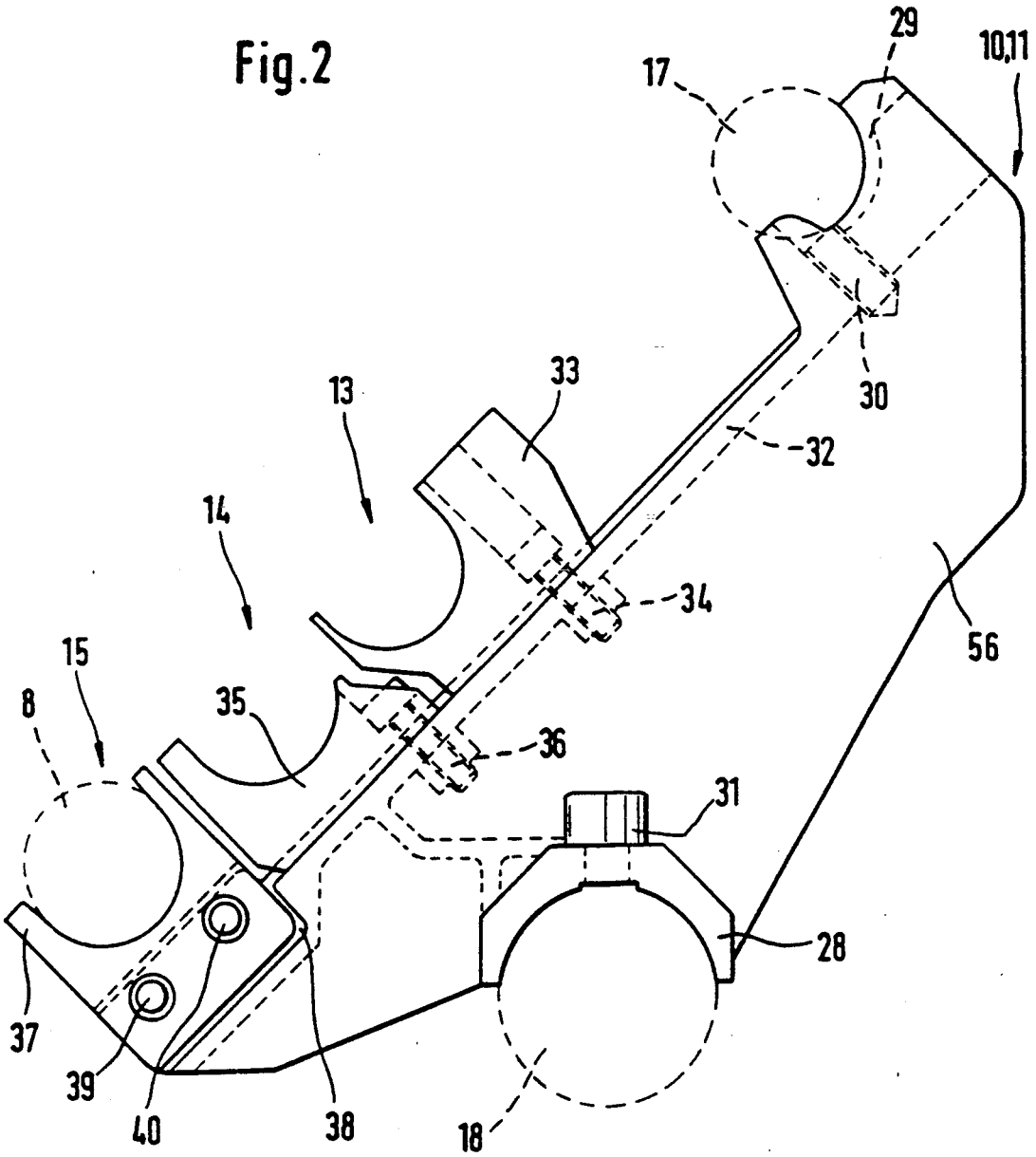
FIG. 2 is a lateral view, which is enlarged with respect to FIG. 1, of a first embodiment of a roller stand of the ring spinning machine of FIG. 1, with a radially adjustable bearing point for the delivery bottom cylinder.

The roller stand 10, 11 shown in a lateral view in FIG. 2 is equipped with devices for adjusting the bearing point 15 for the delivery bottom roller 8. The roller stand 10, 11 essentially comprises a basic body 56 which is equipped with receiving devices 28, 29 for the longitudinal supports 17, 18 shown in FIG. 2 by an interrupted line. Screws 30, 31 are provided for the fastening of the roller stand 10, 11 to the longitudinal supports 17, 18. The receiving devices 28, 29 for the longitudinal supports 17, 18 are rigidly mounted in the basic body 56 of the roller stand 10, 11.

Bearing receiving devices 33, 35 are provided in the case of the roller stand 10, 11 for the bearing points 13, 14 of the bottom rollers 6, 7. These bearing receiving devices 33, 35 can each be slid in the manner of a carriage inside a guide 32 which is molded to the basic body 56 of the roller stand 10, 11 and extends transversely with respect to the direction of the axis of the bottom rollers 6, 7. Because of the slidability of the bearing receiving devices 33, 35, the distances of the bottom rollers 6, 7 with respect to one another and with respect to the delivery bottom roller 8, which is illustrated by an interrupted line in FIG. 2, may be adjusted and may be fixed by means of the screws 34, 36.

In the case of the roller stand 10, 11 of FIG. 2, the bearing point 15 can be adjusted in the radial direction of the delivery bottom roller 8 in that the bearing receiving device 37 is displaced relative to the basic body 56 and is then fixed in the displaced position by the tightening of the screws 39, 40. The contact surface 47 which is not visible in FIG. 2 (compare FIGS. 4 and 5) of the bearing receiving device 37 will then be pressed firmly against the mating surface 38 of the basic body 56.

As illustrated in FIGS. 3 and 4, the bearing receiving device 37 comprises an upper area with a recess of a semicircular cross-section for receiving the bearing for the delivery bottom roller 8 and a lower area which contains the components required for the adjusting and the fastening to the basic body 56 of the roller stand 10, 11. In the lower area, the bearing receiving device 37 is recessed in such a manner along approximately half the broadside that the remainder forms a projection 57 in the shape of a right parallelepiped with a contact surface 47 extending in parallel with respect to the radial plane of the delivery bottom roller 8. The projection 57 of the bearing receiving device 37 comprises the bores 41, 42, of which only the bore 42 is visible in FIGS. 4 and 5. However, the conditions in bore 41 are identical to those in bore 42. After the assembly, the screws 39, 40 are guided through the bores 41, 42. As shown in FIG. 4, bore 42 has an area 45 with a reduced cross-section and an area 45 with an enlarged cross-section. After the assembly, the screw head 48 is to be received in the area 45 with the enlarged cross-section.

FIG. 5 shows the area of the basic body 56 of the roller stand 10, 11 in which the bearing receiving device 37 is adjustably mounted. In this area, the basic body 56 is provided with a projection 58 in the shape of a right parallelepiped whose shape corresponds to the recess in the lower area of the bearing receiving device 37 and which can be received in it completely or partially. The projection 58 of the basic body 56 has a mating surface 38 which is disposed opposite the contact surface 47 of the bearing receiving device 37. It is provided with two threaded bores 50 of the same construction which are disposed opposite bores 41, 42 of the bearing receiving device 37, in which case, of the two threaded bores, only the threaded bore 50 assigned to the bore 42 is visible in FIG. 5. In the representation according to FIG. 5, the screw 39, 40 is partially screwed by means of its threaded pin 49 into the threaded bore 50 of the projection 58 of the basic body 56. The diameter of the area 46 of the bore 42 is slightly larger than the diameter of the threaded pin 49 of the screw 39, 40. Likewise, the widened area 45 of the bore 42 has a slightly larger diameter than the head 48 of the screw 39, 40. Therefore, a radial play exists between the screw 39, 40 and the bore 42 in the narrowed area 46 as well as in the widened area 45. This also applies to bore 41 which is not visible in FIGS. 4 and 5. Because of the play, it is possible to slide the bearing receiving device 37. Corresponding to the requirements, the bearing receiving device 37 can be adjusted so that the delivery bottom roller 8, which is illustrated very schematically by means of interrupted lines in FIG. 5, takes up the desired radial position. After the adjusting, the screws 39, 40 are tightened whereby the contact surface 47 is pressed against the mating surface 38.

Conventional roller stands may be used as roller stands 9, 12 with non-adjustable bearing points 16. In the case of these conventional roller stands, the bearing receiving device for the delivery bottom cylinder is in each case in one piece with the basic body of the roller stand. However, it would also be possible to use the above-described roller stand illustrated in FIGS. 2 to 5 and in this case to fasten the bearing receiving device 37 to the basic body 56 in such a manner that it can no longer be adjusted. This may take place, for example, by a screwing-together and an additional pinned connection. The bearing receiving device 37 illustrated in FIG. 3 has bores 43, 44 which may be used for receiving pins. These bores 43, 44, which may be provided in the case of all bearing receiving devices 37, that is, in the case of the bearing receiving devices 37 for the non-adjustable bearing points 16 as well as for the adjustable bearing points 15, have no function per se in the case of the adjustable bearing points 15.

However, it is naturally also possible to establish, in the case of the adjustable bearing points 15, an additional pinned connection after the adjusting operation between the bearing receiving devices 37 and the basic body 56.

FIGS. 8 to 12 illustrate another embodiment of a roller stand 10, 11 with an adjustable bearing point 15 for the delivery bottom cylinder. The roller stand 10, 11 corresponds essentially to the roller stand 10, 11 illustrated in FIG. 2; that is, it has receiving devices for the fastening of the cylindrical longitudinal supports 17, 18, in which case FIG. 8 shows only the receiving device 28 with the screwed connection 31. It also has a rail 32 in which the bearing carriages are slidably fastened for the bottom cylinders disposed in front of the delivery bottom cylinder. However, the roller stands 10, 11 of FIG. 8 differ from the roller stand 10, 11 of FIG. 2 with respect to the design of the area receiving the bearing receiving device for the delivery bottom cylinder. The basic body 63 of the roller stand of FIG. 8 has a different design than the basic body 56 of FIG. 2.

The adjustable bearing 15 of the embodiment illustrated in FIGS. 8 to 12 comprises a plate-shaped bearing receiving device 67 which, in the case of the basic body 63 of the roller stand 10, 11, is arranged to be radially adjustable relative to the delivery bottom cylinder. In the area of the bearing point 15, the basic body 63 has a slot 66 in which the bearing receiving device 67 is received. For the adjustment, the bearing receiving device 67 may be displaced inside the slot 66 and may be fastened by means of a screw 70 in such a manner that it rests against the basic body 63 in an immobile manner. The displacing movement takes place along a guide which will be described in the following and whose slideways come to rest against the pin 71 of the basic body 63 illustrated in FIG. 8.

Figure 9:
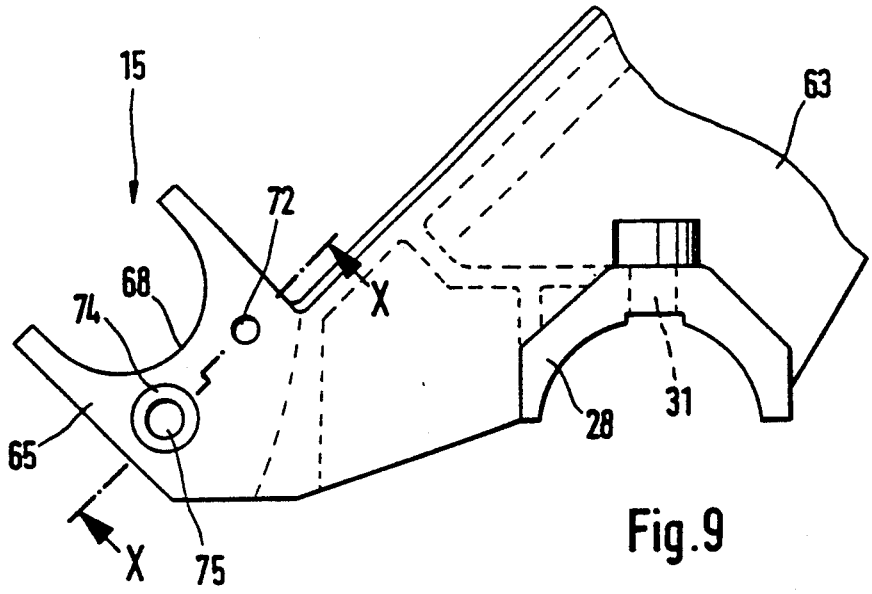
FIG. 9 is a partial view of the basic body of the roller stand of FIG. 8.
Figure 10:
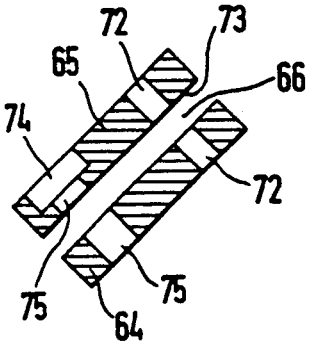
FIG. 10 is a sectional view along Line X—X of the basic body of FIG. 9.

FIGS. 9 and 10 illustrate the area of the adjustable bearing point 15 of the basic body 63 without the plate-shaped bearing receiving device 67. As mentioned above, the basic body 63 has a slot 66 in the mentioned area which divides the basic body 63 in the area of the bearing point 15 into two legs 64 and 65. In the mentioned area of the bearing point 15, the basic body 63 has a bore 72 and a bore 75 which penetrate the two legs 64, 65. After the mounting of the plate-shaped bearing receiving device 67 (compare FIG. 8), the bore 72 is used for receiving the pin 71 and has a diameter which is equal to that of the pin 71. The bore 75 has a slightly larger diameter than the threaded pin 79 of the threaded screw 70 which can be screwed into a threaded bore 77 of the plate-shaped bearing receiving device 67 (compare FIG. 11) so that a radial play becomes possible between the threaded screw 70 and the bore 75. The widened area 74 of the bore 75 is used for receiving the screw head, in which case the mentioned widened area 74 has a diameter which is enlarged with respect to the screw head. The inner width of the slot 66 (compare FIG. 10) is slightly larger than the thickness of the plate-shaped basic body 67 (compare FIG. 12). In the area of the bearing point 15, the basic body 63 has a half-shell-shaped recess 68 whose radius of curvature is slightly larger than the radius of curvature of the outer ring of the bearing, which is not shown in the drawing, for the delivery bottom cylinder.

Figure 11:
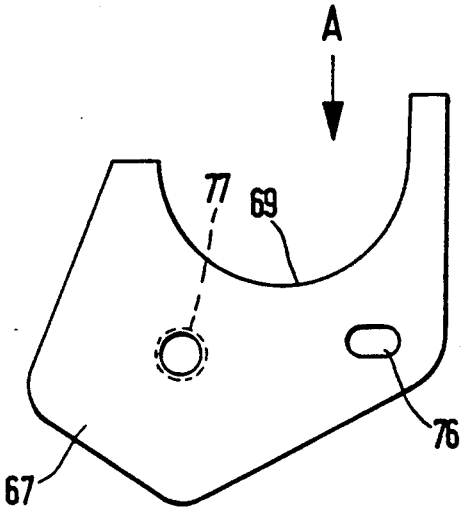
FIG. 11 is a lateral view, which is enlarged with respect to FIG. 8, of the bearing receiving device for the delivery bottom cylinder in the case of the roller stand of FIG. 8.
Figure 12:
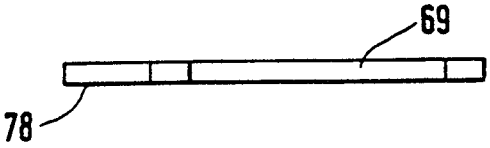
FIG. 12 is a view in the direction of the arrow A of the bearing receiving device of FIG. 11.

The plate-shaped bearing receiving device 67 which is shown in FIGS. 11 and 12 has a half-shell-shaped recess 69, the radius of curvature of which is just as large as the radius of curvature of the outer ring of the bearing of the delivery bottom cylinder. After the assembly, the outer ring of the bearing is form-lockingly disposed in the half-shell-shaped recess 69 of the plate-shaped bearing receiving device 67. The plate-shaped bearing receiving device 67 has an oblong hole 76 whose width corresponds to the diameter of the pin 71 (compare FIG. 8). It also has a threaded bore 77 into which the threaded screw 70 is screwed after the assembly. The plate-shaped bearing receiving device 67 has such an outer contour that it can be accommodated at least partially in the slot 66 of the basic body 63. At least, it can be accommodated in the slot 66 to such an extent that the half-shell-shaped recess 69 can be brought into a position that is aligned with the recess 68 in any arbitrary area of the curvature.

During the assembly, the plate-shaped bearing receiving device 67 is introduced into the slot 66 in such a manner that the threaded bore 77 is disposed inside the bore 75 and the bore 72 is disposed inside the oblong hole 76. Then the pin 71 can be pressed into the bore 72. From the leg 65, the threaded screw 70 is screwed through the bore 75 into the threaded bore 77 of the plate-shaped bearing receiving device 67 but is not yet tightened. The contact surface 78 of the plate-shaped bearing receiving device 67 is disposed opposite the mating surface 73 of the basic body 63 of the roller stand 10, 11. For the adjusting, the plate-shaped bearing receiving device 67 can be displaced along its contact surface 78, in which case the longitudinal sides of the oblong hole 76 are used as slideways and slide along the pin 71. The bore 75 which is produced with an enlarged diameter permits a radial play of the threaded screw 70 which is screwed into the threaded bore 77 of the plate-shaped bearing receiving device 67 and thus a movement of the plate-shaped bearing receiving device 67 along its contact surface 78 within the limits provided by the diameter of the bore 75. The half-shell-shaped recess 69, in which the outer ring of the bearing of the delivery bottom cylinder is form-lockingly received, can be moved to such an extent that a partial area of its curvature would be in alignment with the half-shell-shaped recess 68 of the basic body 63 having a larger radius of curvature. In such a position, the outer ring of the bearing of the delivery bottom cylinder would contact the recess 68 which has a larger radius of curvature than the outer ring of the bearing. As a rule, this will not take place. On the contrary, as a rule, the recess 69 of the plate-shaped bearing receiving device 67 will take up a position which is elevated with respect to the recess 68 of the basic body 63, as indicated, for example, in FIG. 8.

After the alignment and the adjusting of the plate-shaped bearing receiving device 67, the screw 70 is tightened. The contact surface 78 of the plate-shaped bearing receiving device 67 is then pressed firmly against the mating surface 73 of the basic body 63. It is possible but, as a rule, not required to provide the plate-shaped bearing receiving device 67 with an additional pinned connection in the adjusted position.

FIGS. 6 and 7 illustrate an embodiment of a roller stand 9, 12 with a non-adjustable bearing point 16 for the delivery bottom cylinder. In this case, a basic body 59 is used which essentially corresponds to the basic body 63 for adjustable bearing points 15 illustrated with respect to FIGS. 8 to 12. Like the above-described basic body 63, the basic body 59 has a half-shell-shaped recess 62 in the area of the bearing receiving device 60 whose radius of curvature corresponds to the radius of curvature of the half-shell-shaped recess 68 of the basic body 63, and is therefore slightly larger than the outer ring of the bearing of the delivery bottom cylinder which is not shown in the drawing. In contrast to the basic body 63 shown in FIGS. 8 and 9, the basic body 59 has a projection 61 instead of the slot 66, this projection 61 extending in a ring-shaped manner inside the half-shell-shaped recess 62 and having a smaller radius of curvature than the half-shell-shaped recess 62. The radius of curvature of the projection 61 corresponds to the radius of curvature of the half-shell-shaped recess 69 of the plate-shaped bearing receiving device 67 according to FIGS. 11 and 12. Therefore, the projection 61 has the same curvature as the outer ring of the bearing of the delivery bottom cylinder which is not shown in the drawing. After the assembly, the outer ring of the bearing of the delivery bottom cylinder is disposed in a form-locking manner in the projection 61. The projection 61, just like the half-shell-shaped recess 69 of the plate-shaped bearing receiving device 67, is therefore used for the form-locking accommodation of the outer ring of the bearing of the delivery bottom cylinder. The difference is only the fact that, because of the mobility of the plate-shaped bearing receiving device 67 inside the basic body 63 of the roller stand 10, 11, the adjustability of the bearing point 15 becomes possible. The described design of the two basic bodies 59 and 63 permits a simplified manufacturing because, during the manufacturing of the basic body 63, the projection 61 existing in the case of the basic body 59 must only be milled off in order to obtain the slot 66.

The type and extent of the adjusting depends significantly on the position of the roller stand 10, 11 relative to the longitudinal supports 17, 18. During the assembly of the roller stands 10, 11, the receiving devices 28 and 29 are firmly screwed together with the cylindrical longitudinal supports 17, 18 (compare FIG. 2). Since, as a result, the roller stand 10, 11 is fixed in two points, the assembly frequently leads to an inaccurate position of the bearing point 15 which is not in alignment with the straight dimension of the delivery bottom roller 8, particularly when the longitudinal supports 17, 18 which are aligned only by the eye, have deflections. This inappropriate position of the bearing point 15 can be corrected by the adjusting of the bearing receiving device 37 relative to the roller stand 10, 11.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A textile machine comprising:

a machine frame having supports which extend in the longitudinal direction of the machine, the machine frame being divided in the longitudinal direction of the machine frame into several machine sections which each contain a plurality of roller stands, wherein the roller stands are fastened to the supports of the machine frame and contain bearing receiving devices;

a plurality of drafting units, each drafting unit containing a delivery bottom cylinder arranged stationarily in the machine frame and two bottom cylinders which are adjustable relative to one another and to the delivery bottom cylinder, each bottom cylinder in the longitudinal direction of the machine frame being formed of joined together cylinder sections and provided with a drive on at least one machine end;

roller bearings in the bearing receiving devices which hold the bottom cylinders in the bearing receiving devices;

at least one of the roller stands in each machine section having a stationary bearing receiving device for a bearing of the delivery bottom cylinder, and a plurality of roller stands in each machine section having one adjustable bearing receiving device for a bearing of the delivery bottom cylinder;

wherein the adjustable bearing receiving devices are adjustably fixable to a position of the delivery roller cylinder predetermined by the stationary bearing receiving devices.

2. A textile machine according to claim 1, wherein the bearing supports include a radially non-adjustable bearing support for the delivery bottom cylinder at a distance of at least one radially adjustable bearing support.

3. A textile machine according to claim 1, wherein the bearing supports are rigidly fastened in bearing receiving devices which, in the case of the radially adjustable bearing supports such that they can be slid in the radial direction of the delivery bottom cylinder.

4. A textile machine according to claim 3, wherein at least one of the bearing supports and the bearing receiving devices are fastened to holding devices which are connected with the machine frame at a spacing of several drafting units.

5. A textile machine according to claim 4, wherein the holding devices are fastened to at least one longitudinal support of the machine frame.

6. A textile machine according to claim 5, wherein the longitudinal support or supports rest on perpendicular supports of the machine frame at a spacing of at least one holding device.

7. A textile machine according to claim 5, wherein hinges for loading arms of the drafting units are arranged on one of several of the longitudinal supports.

8. A textile machine according to claim 5, wherein at least one of the longitudinal supports has the shape of at least one of a cylinder and a hollow cylinder.

9. A textile machine according to claim 3, wherein the slidable bearing receiving devices have contact surfaces by means of which they can be placed against mating surfaces connected with the machine frame and can be fixed in an adjusted position by means of fastening devices.

10. A textile machine according to claim 9, wherein the mating surfaces are arranged on holding devices connected with the machine frame.

11. A textile machine according to claim 9, wherein one or several screws, which extend perpendicularly to the contact surfaces and the mating surfaces, are arranged as the fastening devices inside the bores in such a manner that the contact surfaces and/or the screws can be moved in the radial direction of the delivery bottom cylinder relative to the mating surfaces.

12. A textile machine according to claim 9, wherein the contact surfaces and the mating surfaces are arranged at least approximately perpendicularly with respect to the axis of the delivery bottom cylinder.

13. A textile machine according to claim 2, wherein the bearing supports are rigidly fastened in bearing receiving devices which, in the case of the radially adjustable bearing supports such that they can be slid in the radial direction of the delivery bottom cylinder.

14. A textile machine according to claim 13, wherein at least one of the bearing supports and the bearing receiving devices are fastened to holding devices which are connected with the machine frame at a spacing of several drafting units.

15. A textile machine according to claim 14, wherein the holding devices are fastened to at least one longitudinal support of the machine frame.

16. A textile machine according to claim 15, wherein the longitudinal support or supports rest on perpendicular supports of the machine frame at a spacing of at least one holding device.

17. A textile machine according to claim 15, wherein hinges for loading arms of the drafting units are arranged on one of several of the longitudinal supports.

18. A textile machine according to claim 14, wherein at least one of the longitudinal supports has the shape of at least one of a cylinder and a hollow cylinder.

19. A textile machine according to claim 18, wherein the slidable bearing receiving devices have contact surfaces by means of which they can be placed against mating surfaces connected with the machine frame and can be fixed in an adjusted position by means of fastening devices.

20. A textile machine according to claim 19, wherein the mating surfaces are arranged on holding devices connected with the machine frame.

21. A textile machine according to claim 20, wherein one or several screws, which extend perpendicularly to the contact surfaces and the mating surfaces, are arranged as the fastening devices inside the bores in such a manner that the contact surfaces and/or the screws can be moved in the radial direction of the delivery bottom cylinder relative to the mating surfaces.

22. A textile machine according to claim 21, wherein the contact surfaces and the mating surfaces are arranged at least approximately perpendicularly with respect to the axis of the delivery bottom cylinder.

* * * * *